US006015587A

United States Patent [19]

Fran et al.

[11] Patent Number: 6,015,587

[45] Date of Patent: Jan. 18, 2000

[54] LOW TEMPERATURE METHOD FOR PHOSPHOR SCREEN FORMATION

[75] Inventors: Yui-Shin Fran, Hsin-chu; De-An Chang; Chih-Hao Tien, both of Hsinchu, all of Taiwan

[73] Assignee: Industrial Technology Research Institute, Hsin-Chu, Taiwan

[21] Appl. No.: 09/039,500

[22] Filed: Mar. 16, 1998

[51] Int. Cl.[7] ..... B05D 5/06

[52] U.S. Cl. ..... 427/64; 427/72; 427/156; 427/157; 427/226; 427/227; 427/240; 427/356

[58] Field of Search ..... 427/240, 356, 427/157, 156, 226, 227, 64, 72

[56] References Cited

U.S. PATENT DOCUMENTS

| | | | |
|---|---|---|---|
| 4,568,479 | 2/1986 | Trond et al. | 252/301.6 |
| 4,751,427 | 6/1988 | Barrow et al. | 313/503 |
| 4,857,429 | 8/1989 | Hayashi et al. | 430/28 |
| 4,890,022 | 12/1989 | Endo | 307/602 |
| 5,039,551 | 8/1991 | Fujita | 427/64 |
| 5,178,906 | 1/1993 | Patel et al. | 427/64 |
| 5,344,353 | 9/1994 | Jang et al. | 427/64 |
| 5,723,170 | 3/1998 | Kawase et al. | 427/64 |
| 5,843,534 | 12/1998 | Chang et al. | 427/282 |

*Primary Examiner*—Shrive Beck
*Assistant Examiner*—Paul D. Strain
*Attorney, Agent, or Firm*—George O. Saile; Stephen B. Ackerman

[57] ABSTRACT

A process for manufacturing a phosphorescent screen for use in a cathode ray or field emission display, is described. The phosphor layer is applied in the form of a slurry consisting of a powdered phosphor, an ethylene glycol monobutyl ether acetate solvent, and a cellulose acetate butyrate binder. The phosphor concentration is between 30 and 60% by weight, the solvent between 5 and 52.5% and the binder between 17.5 and 35%. If the slurry composition falls within these ranges, then, once the aluminum anode layer is in place, all organic material can be removed by firing at a temperature that is less than 500° C. By keeping the firing temperature below 500° C., roughening of the undersurface of the aluminum is avoided and a more efficient screen is obtained. Data to illustrate this is also provided.

12 Claims, 2 Drawing Sheets

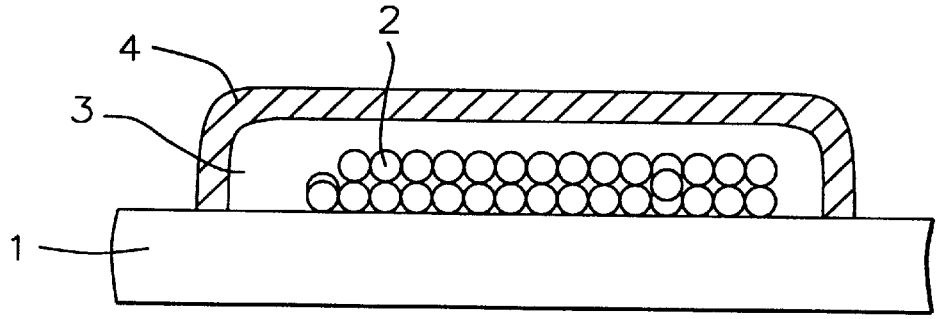
FIG. 1 – Prior Art
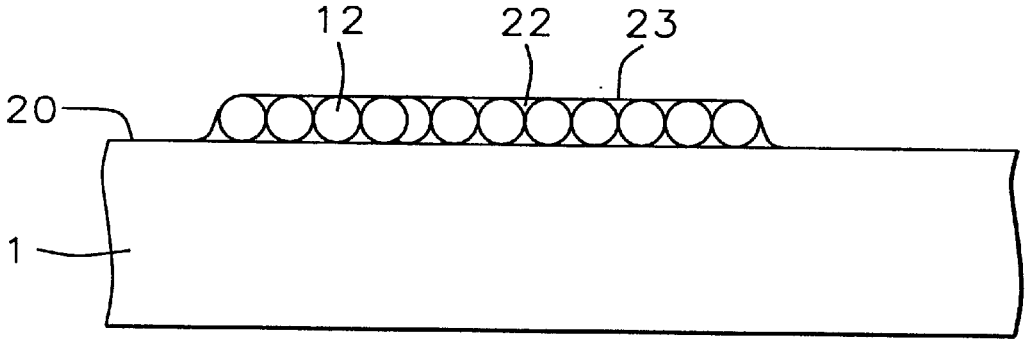
FIG. 2
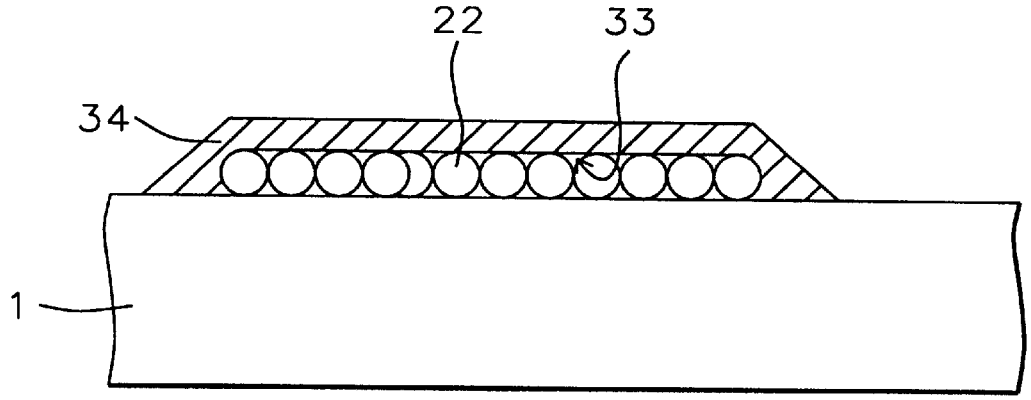
FIG. 3

LOW TEMPERATURE METHOD FOR PHOSPHOR SCREEN FORMATION

FIELD OF THE INVENTION

The invention relates to the general field of phosphors for use in display devices with particular reference to improvements in their efficiency.

BACKGROUND OF THE INVENTION

Materials that emit light when subjected to electron bombardment have long been used to form screens in cathode ray tubes and, more recently, in Field Emission Displays (FEDs). Since these materials, known as phosphors, are relatively poor electrical conductors, it is necessary to back them with a conductive layer to prevent the accumulation of any charge. This layer then serves as the anode of the display system.

Two types of phosphor screen anode are in use. In the first type a layer of a transparent conductor (typically indium tin oxide or ITO) is first deposited onto a transparent substrate and the phosphor layer is then formed on top of the ITO. This design has the advantage of not interfering with the electrons on their way to the phosphor but its efficiency is limited by the fact that any light emitted by the phosphor, in a direction away from the substrate, is lost to the display.

The second type of anode is designed to overcome this deficiency. Instead of ITO, the phosphor layer is formed directly on the substrate following which it is covered with a thin layer of metal, typically aluminum. This metallic anode is thin enough that the electrons are able to pass right through it. Once they reach the phosphor the electrons emit light as in the first type but now light emitted in a direction away from the substrate is reflected by the aluminum layer and is no longer lost to the display.

In FIG. 1 we illustrate the method that has been favored in the prior art for the manufacture of displays having aluminum anodes. Phosphor layer 2 is first laid down on the top surface of substrate 1. Since layer 2 is made up of a large number of individual phosphor particles, its top surface is rough and any metallic film deposited on it will follow the contours of the phosphor layer and therefor also be rough. A rough topography for the underside of the aluminum anode is undesirable because reflection from it will be diffuse making for a less crisp display.

In order obtain an aluminum film with a smooth underside, a common practice was to lay down a layer of lacquer (marked as 3 in FIG. 1) to act as a planarizing medium. Being liquid, the lacquer soon settled into a planar upper surface, following which it was dried and the aluminum film was then deposited directly onto it. Removal of the lacquer layer was then effected by heating in oxygen at around 450° C., leaving behind an aluminum layer having a clean and smooth undersurface.

While the lacquer method decribed above works, a major disadvantage associated with it is that the lacquer is highly toxic so special precautions need to be taken during its use. This slows down the manufacturing process and adds to the cost of the final product.

We have recently filed a patent application (application Ser. No. 08/789,216, now U.S. Pat. No. 5,843,534, on Jan. 24, 1997 by D. A. Chung and J. Y. Lu) which teaches an alternative to the lacquer approach, namely formation of a phosphor slurry which serves the double purpose of facilitating application of the phosphor as well as smoothing out the top surface prior to aluminum deposition. The solvent and binder used to form the slurry are non-toxic and are conveniently removed by firing in oxygen.

The slurry formulation disclosed in application Ser. No. 08/789,216, now U.S. Pat. No. 5,843,534 requires firing at temperatures in excess of 500° C. (about 520° C. being typical). This has the undesired side effect of causing some roughening of the aluminum layer's surfaces which in turn causes some of the light emitted away from the substrate to be reflected in unpredictable directions, reducing the net brightness of the display. The present invention is concerned with preserving the advantages of using a non-toxic slurry but without the aluminum surface roughening problem associated with firing at temperatures in excess of 500° C.

There have been reports in the prior art of attempts to solve similar problems (although none resemble the approach taken by the present invention). For example, Hayashi et al. (U.S. Pat. No. 4,857,429 August 1989) provide optical contact between a powder and a substrate by filling the interstices between the particles with an inorganic material whose refractive index matches that of the particles. Barrow et al. (U.S. Pat. No. 4,751,427 June 1988) describe an electroluminescent device comprising several phosphor layers sandwiched between two layers of aluminum oxide. Power to the device is applied through an aluminum electrode on one face and a transparent conducting electrode on the other face. Trond et al. (U.S. Pat. No. 4,568,479 February 1986) show how a phosphor slurry may be made photosensitive by mixing in suitable additives.

SUMMARY OF THE INVENTION

It has been an object of the present invention to provide a screen, for use in a cathode ray tube or field emission device, that has greater brightness per unit area than similar devices known in the prior art.

Another object of the invention has been to provide a process for manufacturing such a screen without the use of a toxic lacquer.

A further object of the invention has been to provide a non-toxic slurry formulation that may be used in place of a lacquer while also meeting the first objective.

These objects have been achieved by using a slurry consisting of a powdered phosphor, an ethylene glycol monobutyl ether acetate solvent, and a cellulose acetate butyrate binder. The phosphor concentration is between 40 and 50% by weight, the solvent between 10 and 40% and the binder between 24 and 40%. If the slurry composition falls within these ranges, then, once the aluminum anode layer is in place, all organic material can be removed by firing at a temperature that is less than 500° C. By keeping the firing temperature below 500° C., roughening of the undersurface of the aluminum is avoided and a more efficient screen is obtained.

BRIEF DESCRIPTION OF THE DRAWINGS

FIG. 1 is a schematic cross-section of a display screen of the prior art wherein smoothness of the undersurface of the aluminum anode was achieved using a layer of a lacquer as the planarizing medium.

FIG. 2 shows a phosphor layer that has been laid down on a substrate in the form of a slurry.

FIG. 3 shows the finished screen after deposition of the aluminum anode and removal of all organic material.

DESCRIPTION OF THE PREFERRED EMBODIMENTS

Figure 4:
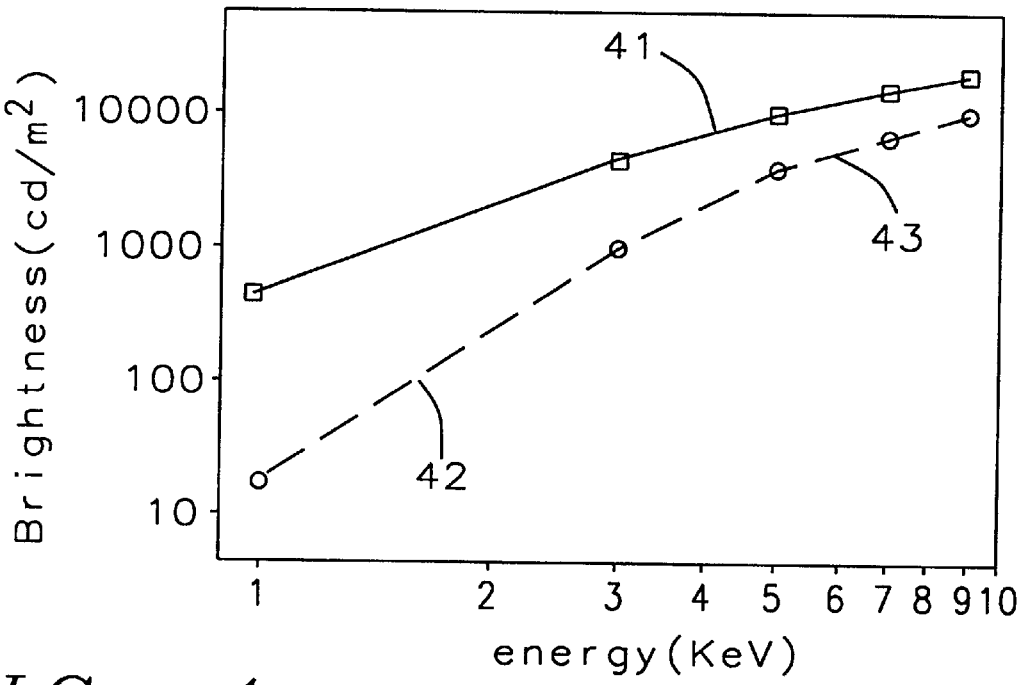
FIG. 4 is a plot of brightness vs. electron energy for a screen having an aluminum anode that was fired at a temperature greater than 500° C.

Two key aspects of the present invention are that a slurry is used to achieve planarization of the phosphor layer prior to deposition of the aluminum layer and that all organic materials are removed from the slurry by firing at a temperature that is less than 500° C. The reduced firing temperature has been made possible by the choice of suitable materials in the correct proportions for the slurry.

The general composition, by weight, of the slurry is as follows:

| | |
|---|---|
| a phosphor in powder form | between about 30 and 60% |
| a liquid solvent | between about 5 and 52% |
| and a binder | between about 17.5 and 35% |

Our preferred phosphor material has been $Y_2O_2$:Tb (P45) but other phosphors such as ZnS:Cu,Al (P22, green) or ZnO (P15) could also have been used.

Our preferred liquid solvent has been butoxyethyl acetate but other solvents such as butoxyethyl laurate or butoxyethyl oleate could also have been used.

Our preferred binder material has been Cellulose Acetate Butyrate but other binders such as Cellulose Acetate Propionate or Cellulose Acetate could also have been used.

Two examples of specific compositions, using the preferred ingredients for the slurries, are:

| | |
|---|---|
| 1) $Y_2O_2S$:Tb (P45) as phosphor | 40% |
| ethylene glycol monobutyl ether acetate as solvent | 30% |
| cellulose acetate butyrate as binder | 30% |
| 2) ZnS:Cu,Al (P22, green) as phosphor | 50% |
| ethylene glycol monobutyl ether acetate as solvent | 15% |
| cellulose acetate butyrate as binder | 35% |

For all compositions falling within the ranges stated above, all organic material could be removed from the slurry by firing at a temperature less than 500° C.

Referring now to FIG. 2, we describe a process for manufacturing a phosphorescent screen using slurries of the type described above. It is assumed that the phosphor of choice is available in powder form at a particle size between about 5 and 10 microns, otherwise it will first need to be ground to this size.

After the binder and the solvent have been blended, the powdered phosphor is added to form the slurry. To ensure uniform distribution of the phosphor within the slurry, blending by means of a three roll miller is done for about 20 minutes. Then, as seen in FIG. 2, slurry 22 is applied to top surface 20 of substrate 1 to a thickness between about 10 and 20 microns. In general, layer 22 will not cover the entire top surface 20, a certain amount of uncoated space being left.

Any of the standard methods used to lay down slurry layers under controlled conditions may be used for laying down 22. These include screen printing, doctor blading, and spin coating. Note that although the individual phosphor particles (such as 12) do not form a smooth upper surface, the solvent/binder blend has acted as a planarizing medium and the upper surface 23 of layer 22 is smooth. Layer 22 is then dried by heating at between about 70 and 100° C. for between about 10 and 20 minutes in air, the smoothness of the slurry top surface 23 being retained.

Referring now to FIG. 3, aluminum layer 34, between about 500 and 3,000 Angstroms thick, is now deposited over layer 22, fully covering it. Since the underside 33 of aluminum layer 34 will contour slurry top surface 23, a smooth undersurface is assured.

The next step, which concludes the process and is also key to its success, is the removal of all organic material without losing the smoothness of undersurface 33. This is accomplished by firing the entire structure at a temperature that is less than 500° C.—typically at about 470° C. for between about 150 and 180 minutes in air.

Figure 5:
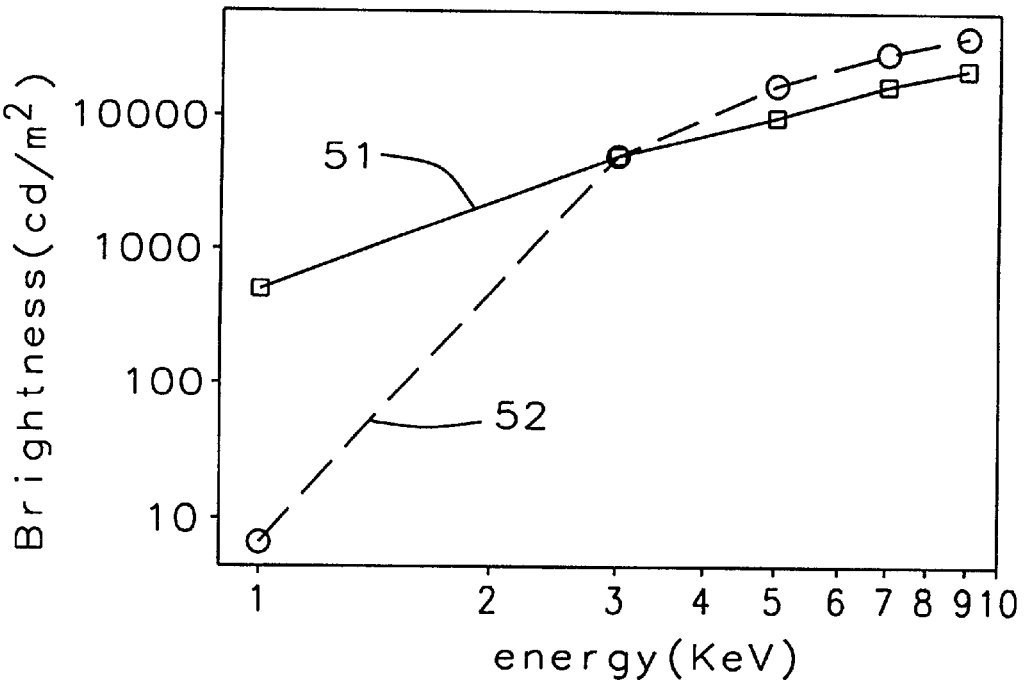
FIG. 5 is a plot of brightness vs. electron energy for a screen having an aluminum anode that was fired at a temperature less than 500° C.

To illustrate the effectiveness of the present invention we refer now to FIGS. 4 and 5. In FIG. 4, we show a plot of screen brightness in candelas per sq. meter vs. electron energy in keV (uncorrected for any attenuation that occurred while passing through the aluminum). Curve 41, provided for reference, is for a screen design of the first type that was discussed earlier, that is the anode was formed from ITO and no aluminum layer was present. Curve 42 is a screen design of the second type in which an aluminum layer was used for the anode instead of ITO, the slurry method was used for applying the phosphor layer, but to remove all organic material the structure was fired at a temperature of about 550° C. As can be seen, the brightness of this structure is below that of the ITO based structure even at the high electron energies pointed to by arrow 43.

In FIG. 5 we show the performance of a screen manufactured according to the teachings of the present invention. As in FIG. 4, reference curve 51 is for an ITO based structure. The slight difference between curves 41 and 51 at low electron energies is because in curve 41 polyvinyl butyrate was used as the binder whereas for curve 51 the binder was cellulose acetate butyrate. Curve 52 is for a screen similar to that seen in FIG. 4, slurry based phosphor with aluminum anode, but firing to remove all organic material took place at 470° C. (i.e. less than 500° C.). As can be seen, for electron energies greater than about 3 keV, the screen of the invention was brighter than the reference by a factor of almost 2 (actual value at 9 keV was 1.7).

The above data confirm that the firing temperature is a critical parameter for optimizing the brightness of screens that use aluminum anodes. Full removal of all organic material from the phosphor at these lower temperatures requires a slurry composition within the range disclosed in the present invention.

While the invention has been particularly shown and described with reference to the preferred embodiments thereof, it will be understood by those skilled in the art that various changes in form and details may be made without departing from the spirit and scope of the invention.

What is claimed is:

1. A process for manufacturing a phosphorescent screen, comprising:

providing a phosphor in powder form, a liquid solvent, a binder, and a substrate;

combining the phosphor, the binder, and the solvent to form a slurry;

applying the slurry to a surface of the substrate thereby forming a layer of phosphor powder and organic material;

heating said layer whereby said organic material dries, thereby providing the phosphor and organic layer with a smooth upper surface;

depositing a layer of aluminum directly on and fully covering said phosphor and organic layer, thereby providing the aluminum layer with a smooth lower surface; and firing the layers at a temperature that is less than 500° C., thereby removing all organic material from the phosphor and organic layer without roughening said smooth lower surface.

2. The process of claim 1 wherein the step of forming a slurry further comprises blending phosphor and binder by means of a three roll miller for about 20 minutes.

3. The process of claim 1 wherein the step of applying the slurry further comprises screen printing or doctor blading or spin coating.

4. The process of claim 1 wherein the slurry is applied to a thicknes that is between about 10 and 20 microns.

5. The process of claim 1 wherein the step of heating the layer further comprises heating at a temperature between about 450 and 500° C. for between about 150 and 200 minutes in air.

6. The process of claim 1 wherein the layer of aluminum is deposited to a thickness between about 500 and 3,000 Angstroms.

7. The process of claim 1 wherein the phosphor is selected from the group consisting of $Y_2O_2$:Tb (P45), ZnS:Cu,Al (P22, green) and ZnO (P15).

8. The process of claim 1 wherein the amount of phosphor present in the slurry is between about 30 and 60% by weight.

9. The process of claim 1 wherein the solvent is selected from the group consisting of butoxyethyl acetate, butoxyethyl laurate and butoxyethyl oleate.

10. The process of claim 1 wherein the amount of solvent present in the slurry is between about 5 and 52.5% by weight.

11. The process of claim 1 wherein the binder is selected from the group consisting of Cellulose Acetate Butyrate, Cellulose Acetate Propionate and Cellulose Acetate.

12. The process of claim 1 wherein the amount of binder present in the slurry is between about 17.5 and 35% by weight.

* * * * *